US006564491B2

(12) United States Patent
Murello

(10) Patent No.: US 6,564,491 B2
(45) Date of Patent: May 20, 2003

(54) FIREARM BOLT ASSEMBLY

(75) Inventor: Johannes Murello, Deisslingen (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 09/916,815

(22) Filed: Jul. 27, 2001

(65) Prior Publication Data

US 2002/0020097 A1 Feb. 21, 2002

(51) Int. Cl.[7] ..... F41A 3/16
(52) U.S. Cl. ..... 42/16; 89/185; 89/187.01
(58) Field of Search ..... 42/16, 25; 89/171, 89/172, 173, 174, 184, 185, 187.01, 188

(56) References Cited

U.S. PATENT DOCUMENTS

| | | | | |
|---|---|---|---|---|
| 3,690,218 A | | 9/1972 | Maillard | 89/185 |
| 3,696,542 A | | 10/1972 | Ekfeldt et al. | 42/16 |
| 4,022,105 A | | 5/1977 | White | 89/149 |
| 4,044,487 A | * | 8/1977 | Hutton et al. | 42/16 |
| 4,563,937 A | | 1/1986 | White | 89/185 |
| 4,655,118 A | | 4/1987 | Bruderer et al. | 89/185 |
| 5,447,092 A | | 9/1995 | Dobbins | 89/187.02 |
| 5,458,046 A | | 10/1995 | Blenk et al. | 89/190 |
| 5,682,007 A | * | 10/1997 | Dobbins | 89/187.02 |
| 6,101,919 A | | 8/2000 | Murello | 89/188 |

FOREIGN PATENT DOCUMENTS

| | | | |
|---|---|---|---|
| DE | 15 78 392 | 5/1971 | |
| DE | 24 43 044 | 4/1975 | |
| DE | 24 18 915 | 10/1975 | 42/16 |
| DE | 197 13 988 C1 | 11/1998 | 42/16 |

OTHER PUBLICATIONS

Translation of European Patent Office *PCT International Preliminary Examination Report*, dated Aug. 15, 2001, in connection with PCT Patent Application Serial No. PCT/EP00/00588, the parent of this application.

Translation of European Patent Office *PCT International Search Report*, dated May 10, 2000, in connection with PCT Patent Application Serial No. PCT/EP00/00588, the parent of this application.

* cited by examiner

*Primary Examiner*—Stephen M. Johnson
(74) *Attorney, Agent, or Firm*—Marshall, Gerstein & Borun

(57) ABSTRACT

An elastic sleeve having a longitudinal slit is positioned between a bolt head and bolt carrier. The sleeve is inserted into an annular space in the bolt carrier when the sleeve is radially compressed allowing relative movement between the bolt head and bolt carrier. The sleeve is supported between the bolt head and an end surface of the bolt carrier when the sleeve is expanded preventing relative movement between the bolt head and the bolt carrier. The periphery of the uncompressed elastic sleeve contacts the bolt carrier or bolt head to thereby effectively damp the elastic sleeve.

10 Claims, 1 Drawing Sheet

FIREARM BOLT ASSEMBLY

RELATED APPLICATION

This application claims priority under 35 U.S.C. §120 from PCT Application Ser. No. PCT/EP00/00588, filed Jan. 26, 2000.

FIELD OF THE INVENTION

The present invention relates generally to firearms, and more particularly to a bolt head and bolt carrier assembly for a semiautomatic weapon which prevents a locking ring from freely vibrating to thereby prevent the locking ring from compressing so far that the locking ring enters an annular space within the bolt carrier.

BACKGROUND

Various bolt head and bolt carrier assemblies are known in the firearm art. For example, a bolt assembly for a semiautomatic weapon is described in U.S. Pat. No. 6,101,919 issued to Murello which claims priority from German Patent DE 197 13 988. In this example, a bolt assembly is constructed from a rotatable bolt head and a bolt carrier. When the bolt assembly is unlocked the bolt head rotates and returns into a longitudinal groove of the weapon housing. During the return into the longitudinal groove, the bolt head is not guided but instead it is held at a fixed distance from the bolt carrier by means of a locking ring.

The locking ring is an elastic sleeve made of spring sheet divided longitudinally by a longitudinal slit. In the loaded, or compressed state, (i.e., when the locking ring is compressed radially), the longitudinal slit is compressed in the peripheral direction and the locking ring has a circular cross section. In the unloaded, or uncompressed state, (i.e., when the locking ring is expanded radially), the longitudinal slit is opened and the locking ring has the cross section of roughly an opened oval.

The bolt head has a rim of locking pegs on its front end, which are distributed in the peripheral direction, similarly to the US M16 automatic rifle. In the unlocked position the rim of locking pegs has a spacing relative to the bolt carrier. The locking ring is in the unloaded state and surrounds the rearward facing shaft of the bolt head. The locking ring is supported against the rear end of the rim and the front end surface of the bolt carrier and, therefore, prevents further penetration of the shaft into the bolt carrier. An annular space surrounding the shaft is formed between the bolt head shaft and the bolt carrier.

In the unlocked position, the rear end of the locking ring sits on the front end surface of the bolt carrier, but cannot penetrate into the annular space because the unloaded locking ring has an oval, or non-circular cross section which is unable to penetrate the annular space. Alternatively, the cross section of the unloaded locking ring may be circular. However, when this locking ring is unloaded, the outside diameter of the locking ring is then greater than the outside diameter of the annular space.

When the bolt assembly is closed, (i.e., moved into the locked position), the bolt head and locking pegs pass between protrusions that are mounted on the weapon housing. The locking ring then contacts a beveled rear edge of the protrusions and is compressed radially into the loaded state. The locking ring is, thereby, tightly compressed around the shaft of the bolt head with its rear end precisely opposite the entrance of the annular space of the bolt carrier. The shaft with the locking ring tightly enclosing it can penetrate into the annular space either partially, or in its entirety.

Upon unlocking of the bolt assembly, the bolt carrier moves rearward relative to the bolt head and releases the front section of the bolt head shaft and the locking ring. After release, the locking ring springs back to its unloaded position and ensures that the spacing between the bolt head and bolt carrier is maintained during any back-and-forth movement until the bolt is relocked.

This known bolt assembly has proven to be reliable in experiments and by its utilization, it has become possible to simplify the design of the bolt housing since the bolt housing no longer has to guide the bolt head. In rare instances, however, the locking ring does not prevent the shaft from penetrating the annular space even when the locking ring is in the unloaded, expanded state.

SUMMARY OF INVENTION

A bolt assembly is provided for use in a firearm having a barrel and a locking element formed at the proximal end of the barrel. The bolt assembly comprises a bolt carrier and a bolt head. It further includes a connecting device operatively coupling the bolt carrier and the bolt head. Mounted on the connecting device is an elastic sleeve having an expanded state, and a compressed state. The elastic sleeve contacts both the bolt carrier and the bolt head in the expanded state, to thereby substantially prevent relative longitudinal movement between the bolt head and the bolt carrier. Compression of the elastic sleeve toward the compressed state permits relative longitudinal movement between the bolt head and the bolt carrier. Means are provided for damping vibrations of the elastic sleeve.

BRIEF DESCRIPTION OF THE DRAWINGS

Like reference numbers in the figures denote the same element whose description with reference to one of the figures is also valid for all the others.

DETAILED DESCRIPTION OF PREFERRED EXAMPLES

Generally, the disclosed bolt assembly described herein represents a modified version of a known bolt assembly. The previous bolt assembly is described in detail by the patentee in U.S. Pat. No. 6,101,919, which is hereby incorporated herein by reference for all purposes.

Throughout this patent, it should be understood that the firearm is horizontally disposed and pointed to the left (the direction of fire) and designations such as "top", "bottom", "front", "rear", "transverse", etc. are made with reference to a firearm in such a position.

The cause of the penetration into the annular space described in the background is assumed to be vibrations of the locking ring, which occur when the longitudinal slit is opened in the peripheral direction and which allow it to "breathe", (i.e., to expand and contract) alternately. Specifically, if the locking ring is rhythmically excited, for example, by continuous firing, vibrations can build up that periodically close and reopen the longitudinal slit. If a longitudinal force acts on the bolt when the longitudinal slit is closed, the locking ring can penetrate the annular space.

Figure 1:
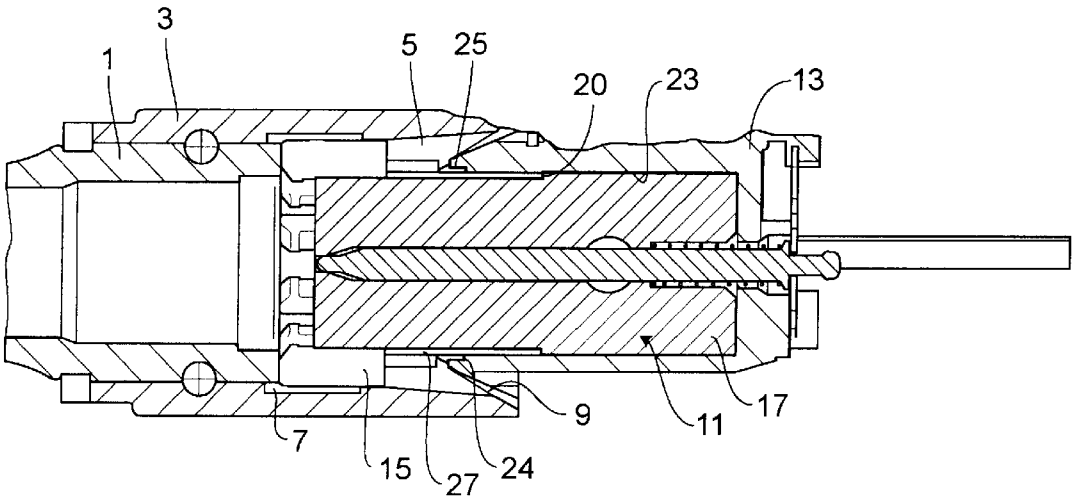
FIG. 1 is a longitudinal cross-sectional view through an exemplary bolt assembly constructed in accordance with the teachings of the invention and with the bolt head in the locked position.
Figure 2:
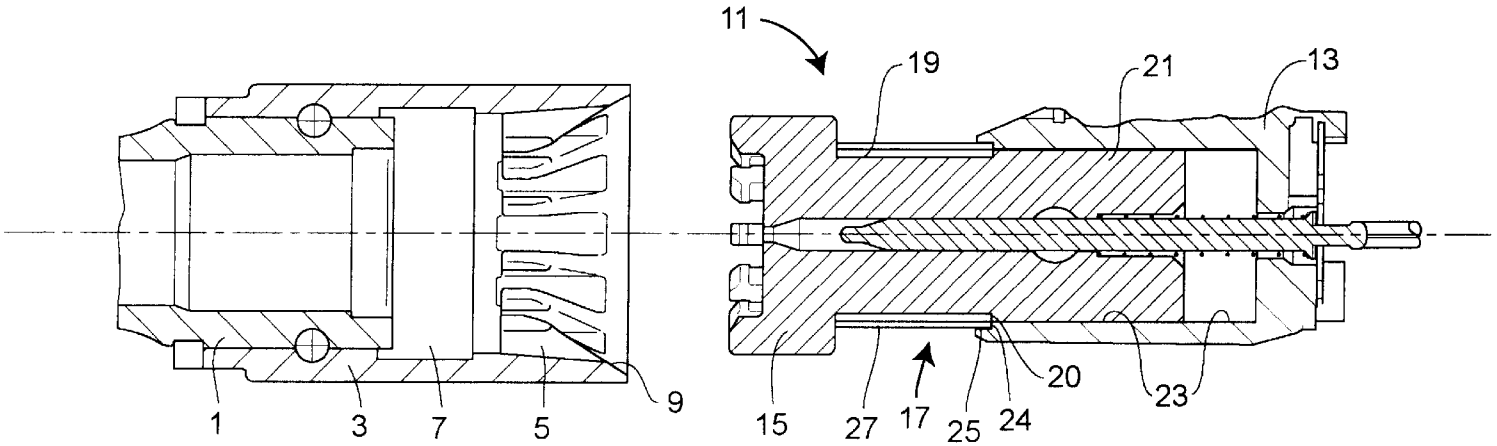
FIG. 2 shows the bolt head of FIG. 1 in the unlocked position.

Thus, to prevent penetration of the annular space, the locking ring vibration must be damped and the vibration amplitude reduced. In other words, the longitudinal slit must be prevented from closing so far during excitations that the locking ring can enter the annular space. FIGS. 1 and 2 illustrate one way to achieve this end.

As shown in FIG. 1, a barrel 1 is provided on whose rear end a rearward protruding sleeve 3 is rigidly attached. The barrel 1 and the sleeve 3 may also be an integrated component. A rim of radial, inward directed protrusions 5 is arranged on the rear of the sleeve 5 between which radially inward, open axial grooves run. The rear end of protrusions 5 has a beveling 9. Between the rear end of the barrel 1 and the front end of protrusions 5, an inward open annular groove 7 is formed.

A bolt head 11 and a bolt carrier 13 form a bolt assembly and are aligned coaxially with respect to each other and to the barrel 1 and the sleeve 3.

The bolt head 11 has an elongated, generally cylindrical shaft 17 on whose front end a rim of locking pegs 15 is formed. The shaft 17 has a front shaft section 19 and a rear shaft section 21. The front shaft section 19 has a smaller diameter than the rear shaft section 21 and runs rearward from the locking pegs 15. A shoulder 20 is formed between the two shaft sections 19 and 21.

The bolt carrier 13 defines a bore, or annular space 23 which is opened to the front. This bore 23 closely matches the diameter of the rear shaft section 21 of the bolt head 11, such that the bore 23 accommodates the rear shaft section 21 with limited play. The bolt carrier 13 is extended forward to thereby form an annular front bore section 25. As shown in FIG. 2, this front bore section 25 forms a capture area adjacent a portion of the front shaft section 19. A bore shoulder 24 is, thus, formed between the front bore section 25 and the remaining portion of bore 23. (The front bore section 25 may optionally have a larger diameter than the remainder of the bore).

The front shaft section 19 of the bolt head 11 is enclosed by an elastic sleeve, for example, a locking ring 27. The locking ring 27 is formed from a sheet of spring steel, has a wall thickness that corresponds to roughly half the difference between the outside diameters of the front shaft section 19 and rear shaft section 21, has a continuous longitudinal slit (not shown) and, in the compressed state (with the longitudinal slit closed), has a generally circular cross section. As shown in FIG. 2, under the influence of spring force of the spring steel, the locking ring 27 springs apart so that the longitudinal slit is open.

The bolt assembly is depicted in an unlocked state in FIG. 2, wherein the bolt head 11 is pulled out from the bolt carrier 13 at least far enough so that the bore shoulder 24 lies between the widened front bore section 25 and the remaining bore 23 precisely at the same height as shaft shoulder 20 or, preferably, slightly wider for reasons of tolerance.

The locking ring 27 is in the widened (essentially load-free) state and sits with its front end on the rear surfaces of the locking pegs 15 and with its rear end on the bore shoulder 24. The locking ring 27, therefore, connects the bolt head 11 to the bolt carrier 13 and prevents further insertion of the bolt head 11 into the bore 23 of the bolt carrier 13.

When the bolt assembly is closed, as depicted in FIG. 1, the locking pegs 15 run between the protrusions 5 until the front edge of the locking ring 27 contacts the beveling 9 of the protrusions 5. During subsequent forward movement, the locking ring 27 is compressed by the beveling 9 far enough so that the front edge of the locking ring 27 lies radially within the protrusions 5. As a result, the locking ring 27 is pressed tightly to the outer periphery of the front shaft section 19 against the action of its spring force, its longitudinal slit is largely closed, and it has assumed a generally circular cross section. The rear end of the compressed locking ring 27 sits on the shaft shoulder 20 formed between the front shaft section 19 and the rear shaft section 21 so that the shaft 17 now has a continuous generally cylindrical outside surface formed by the outer peripheral surfaces of the locking ring 27 and the rear shaft section 21.

As forward movement continues, the shaft 17 penetrates into the bore 23 and the bolt carrier 13 is moved forward relative to the bolt head 11. The bolt head 11 is then rotated by a cam mechanism (not shown but see U.S. Pat. No. 6,101,919) until the locking pegs 15 engage the front of the protrusions 5 to lock the bolt assembly.

To unlock and open the bolt assembly, the bolt carrier 13 is pulled rearward, the bolt head 11 is rotated to disengage the locking pegs 15 from the front of the protrusions 5 and, then, also pulled rearward. The shaft 17 is thereby pulled far enough from the bore 23, as shown in FIG. 2, so that the locking ring 27 leaves the engagement region of the beveling 9 of the protrusions 5. The locking ring 27 then springs radially outward and engages in the bore shoulder 24. The outside periphery of the rear end of the locking ring 27 lies lightly against the inside periphery of front bore section 25. The locking ring 27, therefore, cannot vibrate beyond its reference position or only insignificantly so, and a harmful vibration cannot build up in the locking ring 27. Furthermore, the engagement of the locking ring 27 and the bore shoulder 24, prevents the locking ring 27 from entering the bore 23, and prevents the bolt head 11 from any significant movement relative to the bolt carrier 13.

The above described embodiment illustrates but one means to prevent free vibrations of the locking ring 27. It will be appreciated by those of ordinary skill in the art that other equivalent means of damping may also be used, including for example the use of a locking ring with an increased spring constant, or the use of a thicker spring steel sheet as construction material. These approaches, however, may result in a correspondingly larger force being necessary to lock the bolt assembly.

Another equivalent measure preventing the insertion of the locking ring and shaft into the annular space entails the further expansion of the outside diameter of the unloaded locking ring before incorporation into the bolt assembly. This approach, however, changes the characteristics and the function of the firearm since greater forces must be overcome to cause compression of the locking ring.

In another approach, the rear end surface of the locking ring and the front end surface of the bolt carrier are ground flat in order to avoid any bevelings that could facilitate slippage of the locking ring into the annular space. Alternatively, the axial length of the locking ring is designed and constructed to a more precise tolerance in order to avoid tilting of the locking ring, and thereby prevent any movement of the locking ring and possible inadvertent insertion into the annular space. These approaches, however, have been shown to be cost-intensive.

Other equivalent means for damping are also available. For example, it is possible to generate vibration nodes at least in the rear region of the locking ring, for instance by using connectors, grooves, etc., to reduce the locking ring 27 vibration amplitude. By way of another example, reduction of the vibration amplitude may also be achieved by a nonstraight or sloping longitudinal slit. Alternatively, a vibration-damping material may be used to coat the locking ring, for instance a bimetal strip bent into a ring. These approaches, however, require additional design expense.

Furthermore, while in the illustrated example, the means for damping of the vibration within the locking ring 27 is effected by the contact of the locking ring 27 with the inside periphery of bore section 25, it will be appreciated by those of ordinary skill in the art that the damping means may equivalently be effected by an extension of the bolt head 11. For example, the rear end of the beveling 9 may be extended so that the front end of the locking ring 27 contacts the inside periphery of the extension when the locking ring 27 is in the uncompressed state.

While various examples have been described in this patent, the scope of this patent is not limited to those examples. On the contrary, the scope of this patent is defined by the appended claims.

What is claimed is:

1. For use in a firearm having a barrel and a locking element formed at the proximal end of the barrel, a bolt assembly comprising:

a bolt carrier;

a bolt head;

a connecting device operatively coupling the bolt carrier and the bolt head;

an elastic sleeve mounted on the connecting device and having an expanded state and a compressed state, the elastic sleeve contacting the bolt carrier and the bolt head in the expanded state to thereby substantially prevent relative longitudinal movement between the bolt head and the bolt carrier; whereby compression of the sleeve from the expanded state toward the compressed state permits relative longitudinal movement between the bolt head and the bolt carrier; and means for damping vibrations of the elastic sleeve.

2. A bolt assembly as defined in claim 1 wherein the bolt carrier and the connecting device define an annular space, and the sleeve is sized to enter the annular space when suitably compressed to permit relative movement between the bolt head and the bolt carrier.

3. A bolt assembly as defined in claim 1 wherein the means for damping comprises a forward portion of the bolt carrier, the forward portion of the bolt carrier and the connecting device define an annular space and the sleeve is sized to contact an inside periphery of the forward portion of the bolt carrier adjacent the annular space when uncompressed.

4. A bolt assembly as defined in claim 1 wherein the sleeve comprises a spring plate.

5. A bolt assembly as defined in claim 1 wherein the sleeve includes a slit to permit compression between the expanded state and the compressed state.

6. A firearm comprising:

a barrel with a locking element at the proximal end of the barrel;

a bolt carrier;

a bolt head;

a connecting device operatively coupling the bolt carrier and the bolt head;

an elastic sleeve mounted on the connecting device and having an expanded state and a compressed state, the elastic sleeve contacting the bolt carrier and the bolt head in the expanded state to thereby substantially prevent relative longitudinal movement between the bolt head and the bolt carrier, whereby compression of the sleeve from the expanded state towards the compressed state permits relative longitudinal movement between the bolt head and the bolt carrier; and means for damping vibrations of the elastic sleeve.

7. A firearm as defined in claim 6 wherein the means for damping comprises a forward portion of the bolt carrier, the forward portion of the bolt carrier and the connecting device define an annular space and the sleeve is sized to contact an inside periphery of the forward portion of the bolt carrier adjacent the annular space when uncompressed.

8. A firearm as defined in claim 6 wherein the sleeve comprises a spring plate.

9. A firearm as defined in claim 6 wherein the sleeve includes a slit to permit compression between the expanded state and the compressed state.

10. For use in a firearm having a barrel and a locking element formed at the proximal end of the barrel, a bolt assembly comprising:

a bolt carrier;

a bolt head at least partially received by the bolt carrier;

an elastic sleeve mounted on the bolt head and having an expanded state and a compressed state, the elastic sleeve contacting the bolt carrier and the bolt head in the expanded state to thereby substantially prevent relative longitudinal movement between the bolt head and the bolt carrier, whereby compression of the sleeve from the expanded state towards the compressed state permits relative longitudinal movement between the bolt head and the bolt carrier; and means for damping vibrations of the elastic sleeve.

* * * * *